US006773553B2

(12) United States Patent
Hyvönen et al.

(10) Patent No.: US 6,773,553 B2
(45) Date of Patent: Aug. 10, 2004

(54) METHOD OF MAKING PRESS FELT, AND PRESS FELT

(75) Inventors: Kari Hyvönen, Tampere (FI); Heikki Rehakka, Tampere (FI); Tauno Virtanen, Tampere (FI)

(73) Assignee: Tamfelt Oyj Abp, Tampere (FI)

( * ) Notice: Subject to any disclaimer, the term of this patent is extended or adjusted under 35 U.S.C. 154(b) by 0 days.

(21) Appl. No.: 10/438,892

(22) Filed: May 16, 2003

(65) Prior Publication Data

US 2004/0074624 A1 Apr. 22, 2004

Related U.S. Application Data

(63) Continuation of application No. PCT/FI01/01110, filed on Dec. 17, 2001.

(30) Foreign Application Priority Data

Dec. 18, 2000 (FI) ..... 20002774

(51) Int. Cl.[7] ..... D21F 7/08; D21F 7/10

(52) U.S. Cl. ..... 162/358.2; 162/900; 162/904; 428/192; 428/193; 442/239; 442/270; 28/110; 28/142; 139/383 AA

(58) Field of Search ..... 139/383 A, 383 AA, 139/425 A; 162/358.1, 358.2, 900, 902, 903, 904, 199, 348; 428/192, 193, 212, 222, 223, 57–62; 442/268–275, 203–208, 192–195, 239, 240; 28/110, 141, 142; 34/116, 123

(56) References Cited

U.S. PATENT DOCUMENTS

| | | | | |
|---|---|---|---|---|
| 4,141,388 A | * | 2/1979 | Romanski et al. | 139/383 AA |
| 4,698,250 A | * | 10/1987 | Talonen et al. | 428/58 |
| 4,764,417 A | | 8/1988 | Gulya | |
| 4,863,786 A | * | 9/1989 | Green et al. | 442/241 |
| 5,904,187 A | * | 5/1999 | Davenport | 139/383 AA |
| 6,194,331 B1 | * | 2/2001 | Elkins | 442/225 |
| 6,213,164 B1 | * | 4/2001 | Ostermayer et al. | 139/383 AA |
| 6,302,155 B1 | * | 10/2001 | Rydin | 139/383 AA |

FOREIGN PATENT DOCUMENTS

| | | |
|---|---|---|
| EP | 0 294 951 A1 | 12/1988 |
| EP | 0 367 614 A2 | 5/1990 |
| EP | 1 035 252 A2 | 9/2000 |
| FI | 72767 | 3/1987 |
| FI | 89289 | 5/1993 |
| WO | WO 98/38379 | 9/1998 |

* cited by examiner

*Primary Examiner*—Steven P. Griffin
*Assistant Examiner*—Eric Hug
(74) *Attorney, Agent, or Firm*—Oliff & Berridge, PLC

(57) ABSTRACT

A method of making a press felt, a press felt and a base fabric. The base fabric comprises a surface component on the surface facing the paper web to be dried and a base component below the surface component. The transverse jointing edges of the base component are provided with seam loops, by means of which the base component can be connected into a closed loop. At the first jointing edge of the base fabric the surface component extends for a predetermined distance longer than the base component and forms a seam flap that protects the seam area of the base component.

14 Claims, 4 Drawing Sheets

METHOD OF MAKING PRESS FELT, AND PRESS FELT

This is a Continuation of Application No. PCT/FI01/01110 filed Dec. 17, 2001. The entire disclosure of the prior application is hereby incorporated by reference herein in its entirely.

FIELD OF THE INVENTION

The invention relates to a method of making a press felt, the method comprising forming a base fabric, which comprises at least two super-imposed components, the first of which is a web-side surface component and the second is a base component; weaving the base component of warp and weft yarns and providing a first and a second transverse jointing edges of the base component with seam loops of the weft yarns for interconnection; needling at least one batt fibre layer at least on the base fabric surface facing a web to be dried; and assembling the press felt into a closed-loop piece by arranging the jointing edges of the base fabric edge on edge, whereby the jointing edges form a seam area, where the seam loops intermesh and form a seam loop channel in the transverse direction of the press felt, and a seam yarn, which interconnects the jointing edges, is inserted in the seam loop channel.

The invention also relates to a press felt, which comprises a base fabric and a batt fibre layer attached onto at least the surface of the base fabric facing the web to be dried, and in which press felt the base fabric comprises at least two superimposed components, the first of which is a surface component facing the web to be dried and the second is a base component, and in which press felt the base component is woven of warp yarns and weft yarns, and seam loops of weft yarns are provided at a first and a second transverse jointing edges of the base fabric for interconnection, and in which press felt the press felt can be assembled into a closed loop by arranging the jointing edges of the base fabric edge on edge, whereby the jointing edges form a seam area, where the seam loops intermesh and form a seam loop channel in the transverse direction of the press felt, in which channel the seam yarn inter-linking the jointing edges can be inserted.

The invention further relates to a press felt base fabric, wherein the base fabric comprises at least two superimposed components, the first of which is a surface component facing the web to be dried and the second is a base component; the base component is woven of warp yarns and weft yarns, and seam loops of weft yarns are provided at a first and a second transverse jointing edges of the base fabric for interconnection.

BACKGROUND OF THE INVENTION

The aim of a press section in a paper machine is to drain a web as efficiently as possible without causing any deterioration in the quality of the web, however. From the viewpoint of energy consumption, it is most advantageous to remove as much water as possible already at the press section, whereby there is less need to dry the paper web at subsequent sections of the paper machine. Depending on the press structure, the press section of the paper machine employs a press felt on one or both sides of the web to be dried, into which press felt the water in the web is absorbed. The purpose of the press felt is to transport the water away after pressing without allowing it to migrate back into the web. In pressing, the paper web is conveyed on the felt to a gap between two rolls, i.e. so-called nip. Typically, there are one to four nips in succession, and in each nip water is pressed out of the web into the felt. Consequently, the felt should be such that the water can well be absorbed into the felt pressed in the roll nip. The press felts comprise a base fabric that provides the felt with a necessary space for water, for instance. To make the felt surface smooth, batt fibre is needled onto at least a base fabric surface facing the paper web. The batt fibre thus prevents markings from being produced on the web to be drained. In addition, by means of the batt fibre the water retention capacity of the felt can be adjusted to a desired level such that water is prevented from migrating back from the felt into the web, i.e. so-called rewetting is prevented.

Several alternative ways to weave a base fabric are known. It is possible to weave the base fabric on a weaving machine directly into a seamless, endless loop. On the other hand, it is possible to form base fabric modules provided with seam loops, and a desired number of base fabric modules can be interconnected to form a closed-loop base fabric. In that case the seam loops at the jointing edges of the base fabric modules are intermeshed and connected by inserting a seam yarn in a channel formed by the seam loops. Typically, the seam loops are formed during weaving. The base fabric can be woven in a flat or horseshoe form in known manners.

The press felts provided with seam loops are generally considered to have an advantage that it is easier, quicker and safer to mount them on a paper machine as compared with the closed-loop press felts. The structure of the press section can also be simpler and less expensive. Even though the press felts provided with seam loops have the above-described good properties, they have certain drawbacks, however, which make the felts with seams less desirable. One drawback is, for instance, that the seam loops form a discontinuity in the felt, which produces marking on the web to be dried in the press roll nip. One reason for this is that the thickness of the base fabric is different at the seam. In addition, because yarn density of the base fabric is different in the seam area, permeance of a finished press felt at the seam is different from the rest of the felt. Because the number of yarns in the seam area is lower, adherence of the batt fibre also poses a problem. Further, during use the felt is subjected to tensile stress in the running direction of the machine, which tends to open up the seam area. Discontinuity of this kind produces marking on the web to be dried. In addition, permeance in the seam area is different from the rest of the structure.

BRIEF DESCRIPTION OF THE INVENTION

The object of the present invention is to provide a novel and improved press felt provided with seam loops and a method of making the same.

The method of the invention is characterized by extending a surface component at a first jointing edge of a base fabric for a predetermined distance longer than a base component in the longitudinal direction of the press felt, whereby a seam flap extending over at least the seam area of the base component is provided at the first jointing edge when the base fabric is formed; extending the base component at a second jointing edge of the base fabric for the length of the seam flap longer than the surface component; and needling a batt fibre layer on the base fabric provided with the seam flap.

The press felt of the invention is characterized in that, observed in the longitudinal direction of the press felt, the surface component extends longer than the base component at the first jointing edge of the base fabric and forms at the first jointing edge a seam flap that is designed to extend at least over the base component seam area; that at the second jointing edge of the base fabric the base component extends for the length of the seam flap longer than the surface component; and that the batt fibre layer is attached after forming the seam flap.

The base fabric of the invention is characterized in that, observed in the longitudinal direction, the surface component extends longer than the base component at the first jointing edge of the base fabric and forms at the first jointing edge a seam flap that is designed to extend at least over the base component seam area; and that at the second jointing edge of the base fabric the base component extends for the length of the seam flap longer than the surface component.

The basic idea of the invention is that the base fabric of the press felt comprises at least two superimposed components. On the side facing the web to be dried there is a surface component and below the surface component there is a base component. The transverse jointing edges of the base component are provided with seam loops of weft yarns. Observed in the longitudinal direction, the surface component of the base fabric extends over the seam area and forms a protective seam flap that reduces marking on the web. In addition, the seam flap extending over the seam forms a continuous weave layer, onto which the press felt surface batt fibre can be properly attached also in the seam area. It is possible to make permeance in the seam area correspond, at least approximately, to that in the rest of the press felt. Further, the seam flap protects the seam area of the basic layer from wearing. Discontinuity in the structure is minimized by the seams of the surface component and the base component being at different points in the longitudinal direction of the felt.

The basic idea of an embodiment of the invention is that the surface component and the base component of the base fabric are independent base fabric parts woven in the same step. The surface component and the base component have warp and weft yarns of their own. The components are bound together during weaving by arranging a necessary number of surface component yarns to pass through the base component yarns, or vice versa. Alternatively, the surface component is bound to the base component by means of extra warp- and weft-direction binding yarns that are independent of the component structure. At the first jointing edge of the base fabric, the surface component is woven longer than the base component, whereby a seam flap is formed at the first jointing edge. At the second jointing edge, the weaving of the surface component is stopped at a distance corresponding the seam flap length from the base component edge. This structure is quick to manufacture and stable in use.

The basic idea of an embodiment of the invention is that the surface component and the base component of the base fabric are independent, planar portions that are woven in separate steps and superimposed such that at the first jointing edge the surface component extends longer than the base component, and at the second jointing edge, the base component, in turn, extends for a corresponding distance longer than the surface component.

The basic idea of an embodiment of the invention is that the components are woven simultaneously and that the surface component consists of weft yarns that interlace with the warp yarns of the base component. At the first jointing edge of the base fabric the surface weft yarns extend for the length of the seam flap longer than the base component. At the second jointing edge the situation is opposite, i.e.. the base component extends for the length of the seam flap longer than the surface weft yarns. During weaving, extra warp yarns are applied at the first jointing edge, which warp yarns are arranged to interlace with the surface weft yarns such that the seam flap is provided at the first jointing edge of the base fabric. The weave in the seam flap can be different from the rest of the surface layer. In addition, the cross section, dimensions and material of the seam flap warp yarns can be selected independently of the structure of the base fabric. Thus, the structure of the seam flap can have the desired properties. Permeance of the seam flap can be rendered low, whereby the seam flap compensates for the loose weave of the base component in the seam area.

BRIEF DESCRIPTION OF THE DRAWINGS

The invention will be described in greater detail in the attached drawings, wherein.

Like reference numerals refer to like parts in the figures. For clarity, the figures are simplified.

DETAILED DESCRIPTION OF THE INVENTION

Figure 1A:
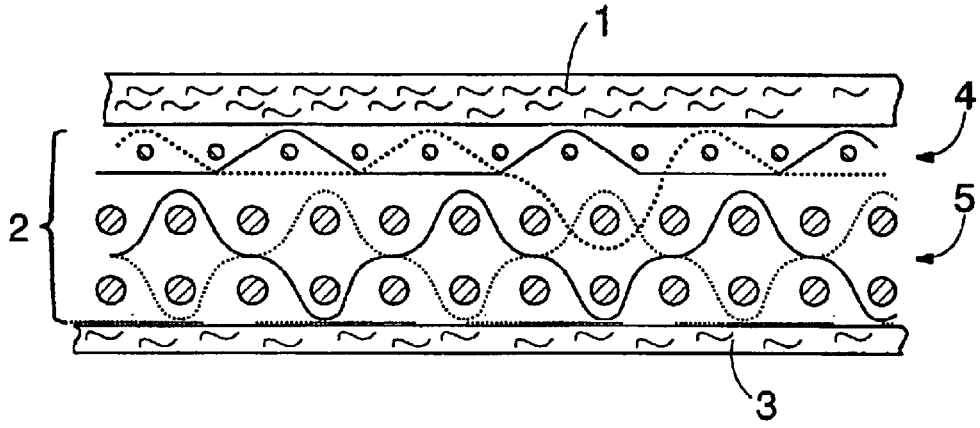
FIG. 1*a* is a schematic view of a cross section of a press felt according to the invention, seen in the direction of weft yarns.
Figure 1B:
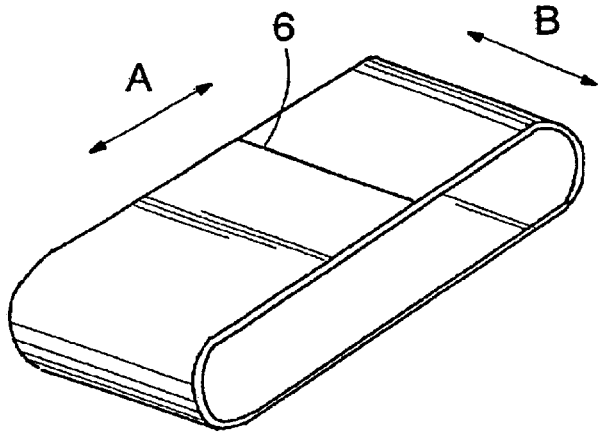
FIG. 1*b* is a perspective view of the press felt connected into a closed loop.

The press felt in FIG. 1*a* comprises three interlinked layers, the topmost of which, i.e. the layer facing the web is a batt fibre layer 1. Below the batt fibre layer there is a base fabric 2, and lowermost there is still one layer of batt fibre 3. The web-side batt fibre 1 prevents markings, i.e. patterning resulting from the weave of the base fabric, from being produced on the surface of the paper web. Typically, the batt fibre layer consists of at least two thinner plies to be needled separately one on top of the other. On the top surface of the batt fibre layer there is, in general, finer batt fibre and coarser batt fibre at the bottom. A batt fibre layer is not necessary at the bottom of the press felt. The base fabric 2 of the press felt is manufactured of warp yarns and weft yarns by weaving. For clarity, the figures of the present document only show a few of the yarns in the weave. The base fabric can be woven of yarns of suitable material and cross section, and weaves known per se can be employed. The laminated base fabric in the figure comprises two superimposed components, i.e. a surface component 4 and a base component 5. In general, the base component has relatively loose texture in order to provide a sufficient space for water, and suitable openness. The aim of the surface component is to provide as smooth a surface as possible, which allows reduction in markings. Some optional structures of the base fabric are described in greater detail in FIGS. 3 to 7. As can be seen in FIG. 1*b*, the press felt is made into a closed loop by interconnecting its jointing edges with a seam 6. The press felt is run on the paper machine in the machine direction A guided by the press section rolls. In the transverse direction B, the width of the press felt corresponds to that of the paper machine.

Figure 2:
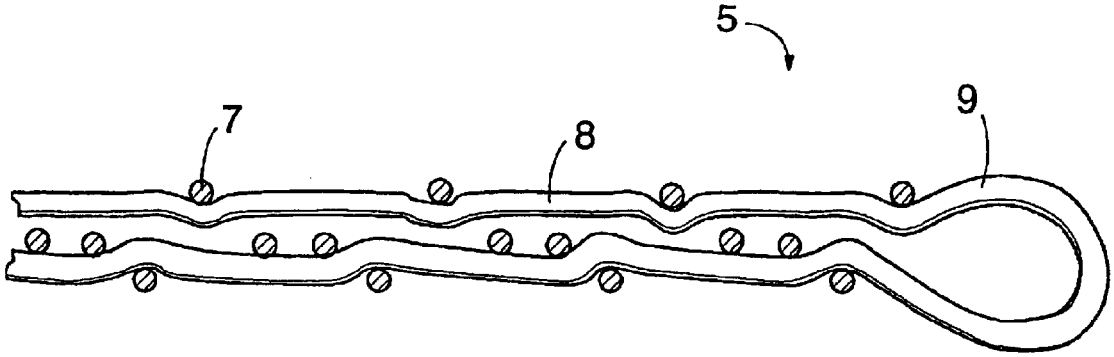
FIG. 2 shows schematically a structure of a base fabric base component of the press felt according to the invention, seen in the direction of warp yarns.

FIG. 2 shows, in a simplified form, one optional structure for a base component 5 of the base fabric. The base component consists of transverse warp yarns 7 and longitudinal weft yarns 8 that interlace. In the structure of the figure, the weft yarns are in two plies, but when necessary, they can be in a plurality of superimposed plies. The superimposed weft yarns in the weave form seam loops 9 at the transverse jointing edges of the base component.

Figure 3:
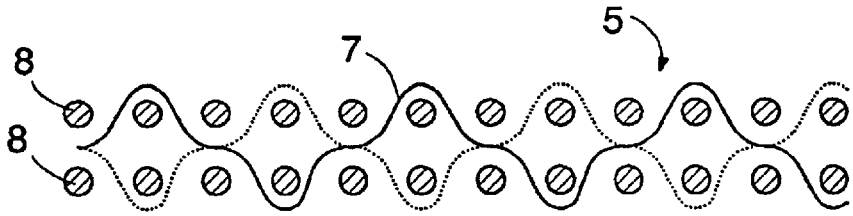
FIGS. 3 and 4 show schematically some structural alternatives of the base component, seen in the direction of the weft yarns.

FIG. 3 shows a base component 5 of the base fabric seen in the longitudinal direction of the felt. The weft yarns 8 forming seam loops are shown in cross section. The weave of the warp yarns 7 and the weft yarns 8 can be selected to meet the need.

Figure 4:
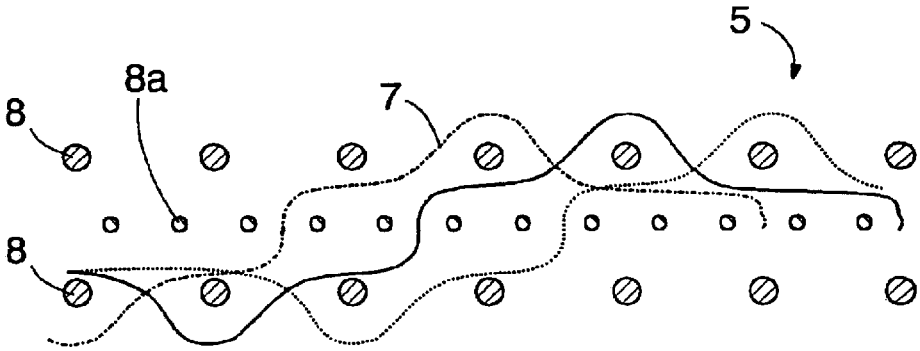

FIG. 4 shows the structure of the base component 5 of the base fabric having weft yarns 8 in three plies. The outermost weft yarns form seam loops at the jointing edge of the basic layer. Between the weft yarns forming the seam loops there are so-called intermediate weft yarns 8*a*, which do not participate in forming the seam loops. The weave position, material and cross section of the intermediate weft yarns can be different from the weft yarns 8 forming the seam loops. Further, the dimensions of the intermediate weft yarns can be selected in a desired relation to the weft yarns forming the seam loops. By means of the intermediate weft yarns it is possible to affect the thickness, grammage and permeance of the base component.

Figure 5:
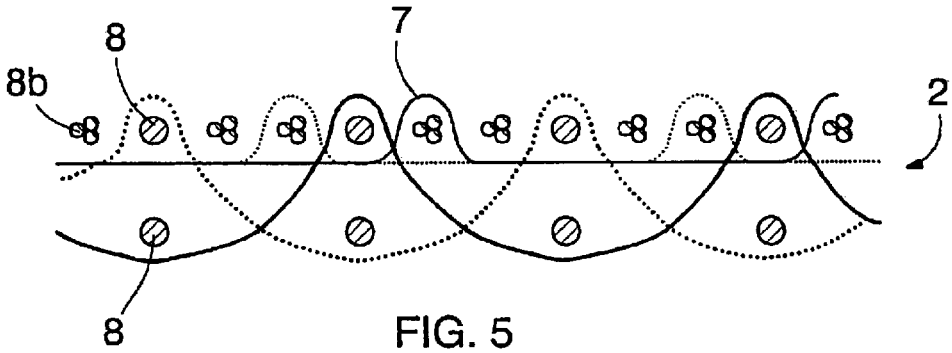
FIG. 5 shows schematically a base fabric according to the invention, seen in the direction of the weft yarns.

FIG. 5 shows the structure of the base fabric 2 having weft yarns 8 in two plies. In addition to the weft yarns 8 forming seam loops, on the surface of the structure there are weft yarns that do not participate in forming the seam loops. These yarns are known as surface weft yarns 8*b*. The surface weft yarns form the surface component of the base fabric, by which the properties of the base fabric are adjusted. The surface component comprises no warp yarns of its own, but the warp yarns 7 of the base component bind the surface weft yarns and the base component into a uniform weave. The base component of this base fabric can comprise, as desired, several plies and intermediate weft yarns as in FIG. 4. The structure is woven on one weaving machine simultaneously, whereby it is quick to manufacture the base fabric. Weaving can be carried out in flat or horseshoe form. Seam loops of the base component weft yarns are formed at both of the transverse jointing edges of the base fabric, by means of which seam loops one or more base fabrics can be interconnected by the jointing edges into one closed loop. Further, at the first jointing edge of the base fabric the surface component is extended longer than the base component in the longitudinal direction of the base fabric, whereby a seam flap protecting the seam area of the base component is formed at the first jointing edge. At the second jointing edge of the base fabric the base component, in turn, extends for the length of the seam flap longer than the surface component. Hence, the seams of the surface component and the base component are in different positions in the longitudinal direction of the press felt, whereby discontinuities resulting from the seams can be avoided. Because the surface component does not comprise warp yarns of its own, extra surface warp yarns, which interlace with the surface weft yarns, are applied for the seam flap portion during weaving. The material, dimensions and yarn density of the surface warp yarns and the weave with the surface weft yarns can be selected independently of the base component structure. Thus, the seam flap portion of the surface component can be denser, whereby the permeance of the base fabric at the seam is substantially the same as in the rest of the base fabric.

Figure 6:
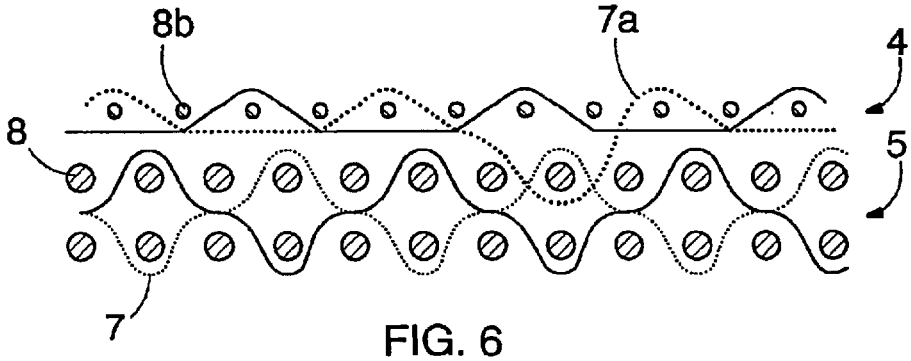
FIGS. 6 and 7 are schematic views, seen in the direction of the weft yarns, of base fabrics, in which independent surface and base components are bound together to form a uniform weave.
Figure 7:
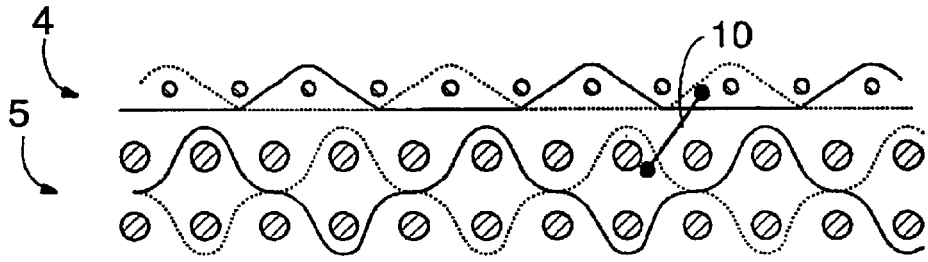

FIG. 6 shows a base fabric structure, in which both the surface component 4 and the base component 5 are independent weave layers comprising warp yarns 7 and weft yarns 8 and 8*b* of their own. The structure and the yarns of the surface component and the base component can be selected independently. Furthermore, the surface component and the base component are woven simultaneously on one weaving machine, which allows fewer steps and quick manufacturing. At predetermined intervals a warp yarn 7*a* of the surface component passes through weft yarns of the base component and binds the components together. Alternatively, the surface component and the base component are bound together by means of an extra warp- or weft-direction binding yarn that is separate from the component structure. FIG. 7 shows a weft-direction binding yarn 10. Further, it is possible to use combinations of FIGS. 6 and 7 in binding the base fabric components. The structure that is bound together during weaving is stable in the press section.

Figure 8:
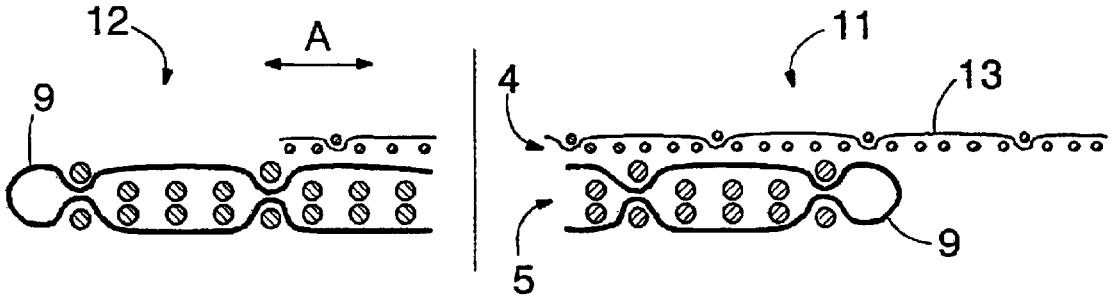
FIG. 8 is a schematic view of the base fabric woven in a flat form.

FIG. 8 shows the structure of a flat-woven base fabric. When woven flat, seam loops 9 of weft yarns are provided at a first jointing edge 11 and a second jointing edge 12 of the base component 5. At the first jointing edge 11, weaving of the surface component 4 is extended for a predetermined distance longer than the base component 5 in the longitudinal direction of the base fabric. The first jointing edge of the surface component 4 is thus provided with a seam flap 13 having a free outer edge. Whereas, at the second jointing edge 12 of the base fabric the base component 5 extends for the length of the seam flap 13 longer than the surface component 4.

Figure 9:
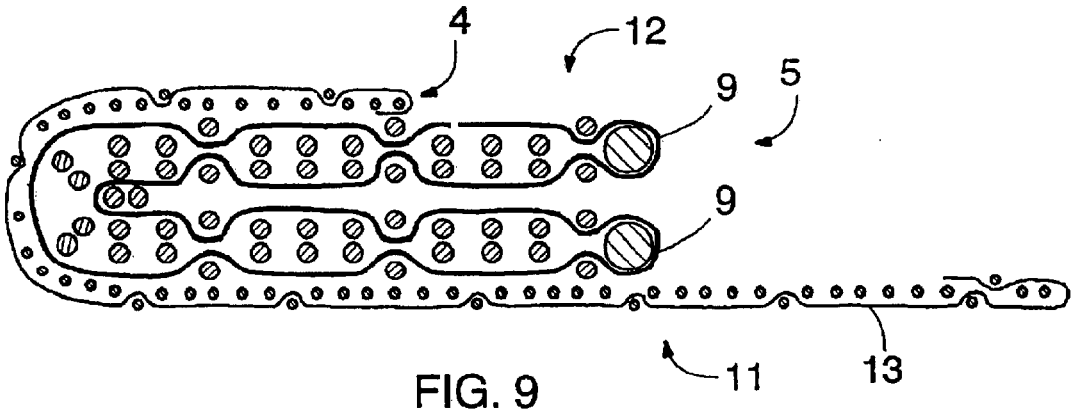
FIG. 9 woven in a horseshoe form.

FIG. 9 illustrates how the base fabric is woven in horseshoe form. Then, the first jointing edge 11, which appears in the figure at a lower weaving level, comprises a seam flap 13. At the second jointing edge 12, which appears in the figure at an upper weaving level, the base component 5 extends for the length of the seam flap longer than the surface component 4.

The components shown in FIGS. 8 and 9 are independent weave layers, which are bound together, for instance, in the manners shown in FIGS. 6 and 7 by means of surface component yarns or extra binding yarns.

Figure 10:
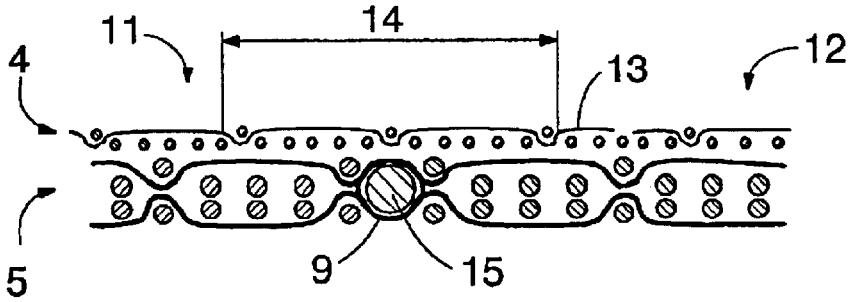
FIG. 10 is a schematic view of the seam area of the base fabric seen in the transverse direction.

FIG. 10 shows a seam area 14 of the base fabric. The seam flap 13 of the first jointing edge 11 extends over the seam area of the base component and forms a continuous weave layer at the seam. Because the second jointing edge lacks the surface component 4 for the length of the seam flap, the seam flap will be in the same plane with the rest of the surface component. Between the jointing edges of the surface component 4 there is a butt seam. The length of the seam flap 13 protecting the seam area is designed according to the press felt structure such that the seam flap provides sufficient cover for the seam area 14.

FIGS. 11 to 14 show highly simplified press felts of the invention seen in the transverse direction. For clarity, batt fibre layers are not shown. To make the components better distinguishable in FIGS. 11 and 12, a broken line indicates the surface component and a continuous line indicates the base component.

Figure 11:
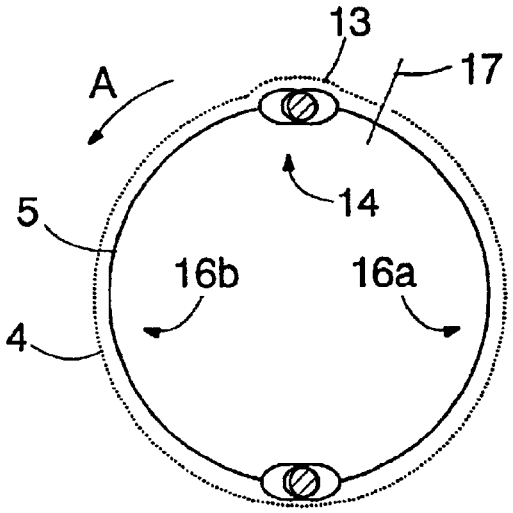
FIGS. 11 to 14 show schematically some solutions according to the invention for protecting the seam area of the base fabric by means of a seam flap belonging to the surface component.
Figure 12:
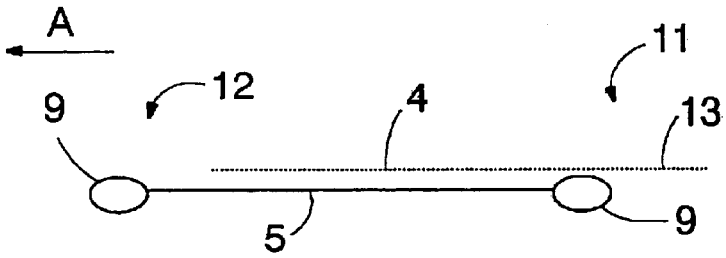

FIG. 11 shows a press felt whose base fabric is assembled of two separately manufactured modules 16*a* and 16*b* by interconnecting the transverse edges of the modules. The press felt can consist of a desired number of modules of the same or different length. The seam in the surface component is indicated by a line of dots and dashes 17. FIG. 12 shows one module of this kind, comprising a surface component 4 and a base component 5. The surface and the base components are in this particular case woven in separate steps. The structure of the surface component and the base component can be selected independently, but the length and the width of the components are substantially the same. After weaving the components are superimposed such that at the first jointing edge 11 the surface component 4 extends longer than the base component 5 and at the second jointing edge 12 the situation is opposite. Thus is formed the seam flap 13 of the invention at the first jointing edge. The surface component and the base component can be pre-connected to one another, for instance, with stitches, soluble yarns or glue, by welding or in any other suitable manner. The components are finally interconnected when the batt fibre is needled onto the base fabric after the seam flap is formed.

Figure 13:
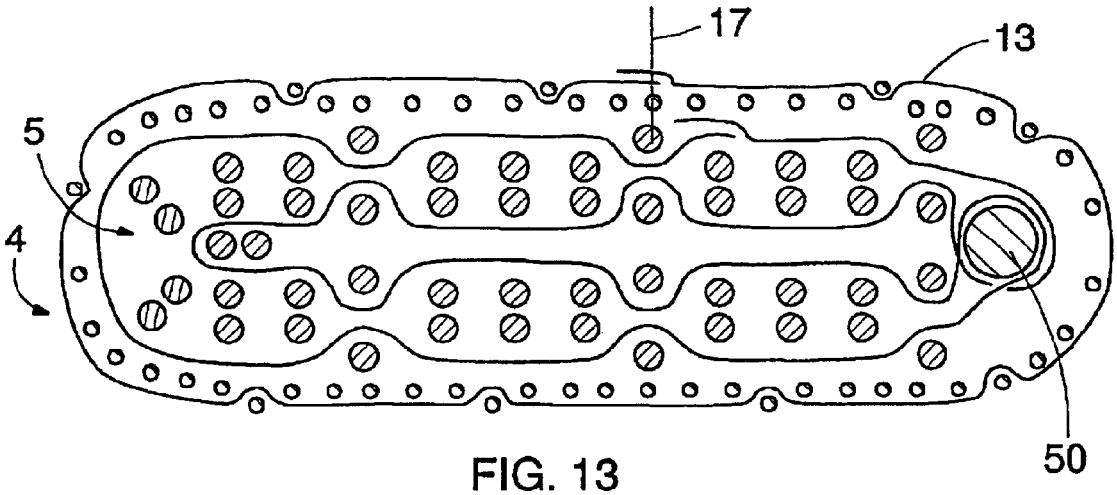

FIG. 13 shows one optional solution to manufacture the base fabric of the invention. In that solution, the base component is woven into an endless structure, and the upper level, and correspondingly the lower level of the right-hand edge of the fabric is provided with seam loops. The figure shows an edge yarn 50, round which the seam loops are woven. A closed-loop surface component is woven simultaneously with the base component on top of the horseshoe form structure. After weaving, the surface component is cut in the transverse direction of the felt such that the surface component will also be provided with jointing edges. The surface component is cut with respect to the base component seam area such that a seam flap of a desired length is provided. At the same time, the binding yarns between the components are cut for the seam flap portion. Thereafter, the base fabric with the seam flap having been formed, the necessary batt fibre can be needled onto the base fabric.

Figure 14:
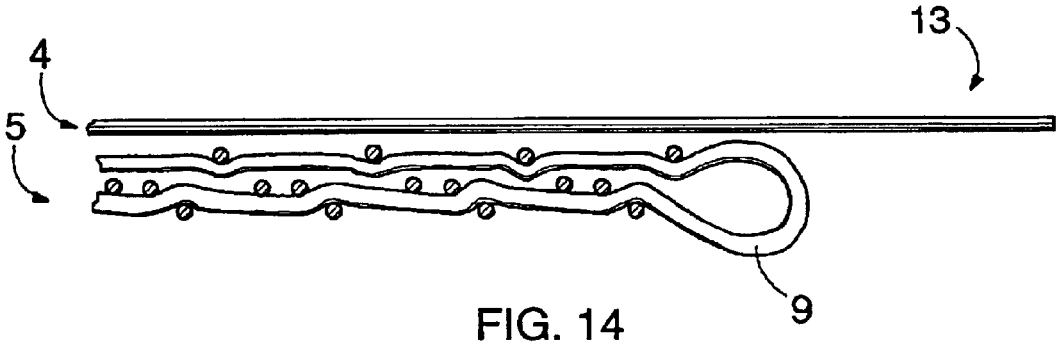

FIG. 14 shows part of the base fabric, in which the base component is woven and the surface component is a non-woven yarn array. The surface component can be formed by winding, for instance. When the surface component only consists of yarns in the longitudinal direction of the felt, there is no risk of fraying.

The drawings and the relating specification are only intended to illustrate the inventive idea. The details of the invention may vary within the scope of the claims.

What is claimed is:

1. A method of making a press felt, comprising:

forming a base fabric, which comprises at least two superimposed components, the first of which is a web-side surface component and the second is a base component;

weaving the base component of warp and weft yarns and providing a first and a second transverse jointing edges of the base component with seam loops of the weft yarns for interconnection;

assembling the press felt into a closed-loop piece by arranging the jointing edges of the base fabric edge on edge, whereby the jointing edges form a seam area, where the seam loops intermesh and form a seam loop channel in the transverse direction of the press felt, and a seam yarn, which interconnects the jointing edges, is inserted in the seam loop channel;

extending the surface component at a first jointing edge of the base fabric for a predetermined distance longer than the base component in the longitudinal direction of the press felt, whereby a seam flap extending over at least the seam area of the base component is provided at the first jointing edge when the base fabric is formed;

extending the base component at a second jointing edge of the base fabric for the length of the seam flap longer than the surface component;

binding the surface component and the base component together before attaching at least one batt fibre layer on the base fabric;

forming a free outer end to the seam flap; and needling the batt fibre layer on the base fabric provided with the seam flap and providing the batt fibre layer at least on the base fabric surface facing a web to be dried.

2. The method as claimed in claim 1, further comprising:

weaving the surface component and the base component of the base fabric in separate steps; and assembling the base fabric by superimposing the independent surface component and the independent base component.

3. The method as claimed in claim 1, further comprising:

weaving the surface component and the base component of the base fabric simultaneously to be independent weave layers each having separate warp yarns and weft yarns;

interconnecting the surface component and the base component during weaving with binding yarns that run between the components; and weaving the surface component for a predetermined distance longer than the base component at the first jointing edge of the base fabric so as to form the seam flap; and weaving the base component for the length of the seam flap longer than the surface component at the second jointing edge of the base fabric.

4. The method as claimed in claim 1, further comprising:

weaving the surface component and the base component of the base fabric simultaneously to be independent weave layers each having separate warp yarns and weft yarns;

interconnecting the surface component and the base component during weaving with binding yarns that run between the components;

weaving the base component in a horseshoe form and the surface component into a closed loop around the base component; and cutting the surface component in the transverse direction at a distance corresponding the length of the seam flap from the jointing edge of the base fabric.

5. The method as claimed in claim 1, further comprising:

forming the base fabric surface component of surface weft yarns which are arranged to interlace with the warp yarns of the base component;

extending the surface weft yarns longer than the base component weft yarns at the first jointing edge of the base fabric so as to form the seam flap;

applying for the seam flap portion surface warp yarns, separate from the base component, which are bound with the surface weft yarns; and extending the base component for the length of the seam flap longer than the surface weft yarns at the second jointing edge of the base fabric.

6. The method as claimed in claim 1, further comprising forming the surface component of a yarn array.

7. The method as claimed in claim 1, further comprising assembling the base fabric base component, in the longitudinal direction, of at least two different weaves whose transverse jointing edges are interconnected in extension of one another.

8. A press felt, comprising a base fabric; and at least one batt fibre layer attached onto at least the surface of the base fabric facing the web to be dried, the base fabric including at least two superimposed components, the first of which is a surface component facing the web to be dried and the second is a base component, the surface component and the base component are bound together before attaching the batt fibre layer on the base fabric.

the base component is woven of warp yarns and weft yarns, and seam loops of weft yarns are provided at a first and a second transverse jointing edges of the base component for interconnection, the press felt can be assembled into a closed loop by arranging the jointing edges of the base fabric edge on edge, whereby the jointing edges form a seam area, where the seam loops intermesh and form a seam loop channel in the transverse direction of the press felt, in which channel the seam yarn interlinking the jointing edges can be inserted, the surface component, observed in the longitudinal direction of the press felt, extends longer than the base component at the first jointing edge of the base fabric and forms at the first jointing edge a seam flap that is designed to extend at least over the base component seam area, and which the seam flap is provided with a free outer end, at the second jointing edge of the base fabric the base component extends for the length of the seam flap longer than the surface component, and the batt fibre layer is attached after forming the seam flap.

9. The press felt as claimed in claim 8, wherein the surface component and the base component of the base fabric are independent weave layers that are woven in separate steps and superimposed when the base fabric is assembled.

10. The press felt as claimed in claim 8, wherein the surface component and the base component of the base fabric are independent weave layers each having separate warp yarns and weft yarns, the surface component and the base component are interconnected during weaving with binding yarns running between the surface component and the base component, the surface component is woven for a predetermined distance longer than the base component at the first jointing edge of the base fabric so as to form the seam flap, and at the second jointing edge of the base fabric the base component is woven for the length of the seam flap longer than the surface component.

11. The press felt as claimed in claim 8, wherein the base fabric surface component consists of surface weft yarns which are arranged to interlace with the warp yarns of the base component, the surface weft yarns extend for the length of the seam flap longer than the weft yarns of the base component at the first jointing edge of the base fabric, the seam flap comprises surface warp yarns, separate from the base component, which interlace with the surface weft yarns, and the base component extends for the length of the seam flap longer than the surface weft yarns at the second jointing edge of the base fabric.

12. The press felt as claimed in claim 8, wherein the base fabric base component comprises at least two weaves interconnected by their jointing edges.

13. The press felt as claimed in claim 8, wherein the surface component is a non-woven structure.

14. A press felt base fabric, comprising a base fabric, the base fabric including at least two superimposed components, the first of which is a surface component facing the web to be dried and the second is a base component, the surface component and the base component are bound together, the base component is woven of warp yarns and weft yarns, and seam loops of weft yarns are provided at a first and a second transverse jointing edges of the base component for interconnection, the surface component, observed in the longitudinal direction, extends longer than the base component at the first jointing edge of the base fabric and forms at the first jointing edge a seam flap which is designed to extend at least over the seam area of the base component, the seam flap is provided with a free out end, and at the second jointing edge of the base fabric the base component extends for the length of the seam longer than the surface component.

* * * * *